United States Patent [19]

Clausen

[11] Patent Number: 4,624,297

[45] Date of Patent: Nov. 25, 1986

[54] BULLET CASTING MACHINE

[76] Inventor: Robert L. Clausen, P.O. Box 881, Chandler, Ariz. 85224

[21] Appl. No.: 780,004

[22] Filed: Sep. 25, 1985

[51] Int. Cl.[4] ..... B22D 33/04; B21K 21/06

[52] U.S. Cl. ..... 164/262; 164/335; 164/341; 164/342; 29/1.22

[58] Field of Search ..... 29/1.2, 1.21, 1.22; 164/342, 341, 335, 262, 137, 70.1

[56] References Cited

U.S. PATENT DOCUMENTS

| | | | |
|---|---|---|---|
| 2,654,939 | 10/1953 | Donath | 164/262 |
| 2,845,669 | 8/1958 | Hackett et al. | 164/137 |
| 2,995,788 | 8/1961 | Sunday | 164/70.1 |
| 3,063,109 | 11/1962 | Rapaport | 164/342 |
| 3,599,707 | 8/1971 | Lauzier | 164/342 |
| 3,745,873 | 7/1973 | Lee | 29/1.22 |
| 4,341,258 | 7/1982 | Wigdahl | 164/342 |
| 4,343,222 | 8/1982 | Dillon | 86/27 |

*Primary Examiner*—Nicholas P. Godici
*Assistant Examiner*—Samuel M. Heinrich
*Attorney, Agent, or Firm*—Warren F. B. Lindsley

[57] ABSTRACT

A manually operated bullet casting machine comprising a mold assembly that is raised to a pouring position by means of a crank and filled from an overhead melting pot through the activation of a lever. The bullets are trimmed and ejected from the mold assembly as the crank is returned to its lowered position.

5 Claims, 5 Drawing Figures

FIG. 1
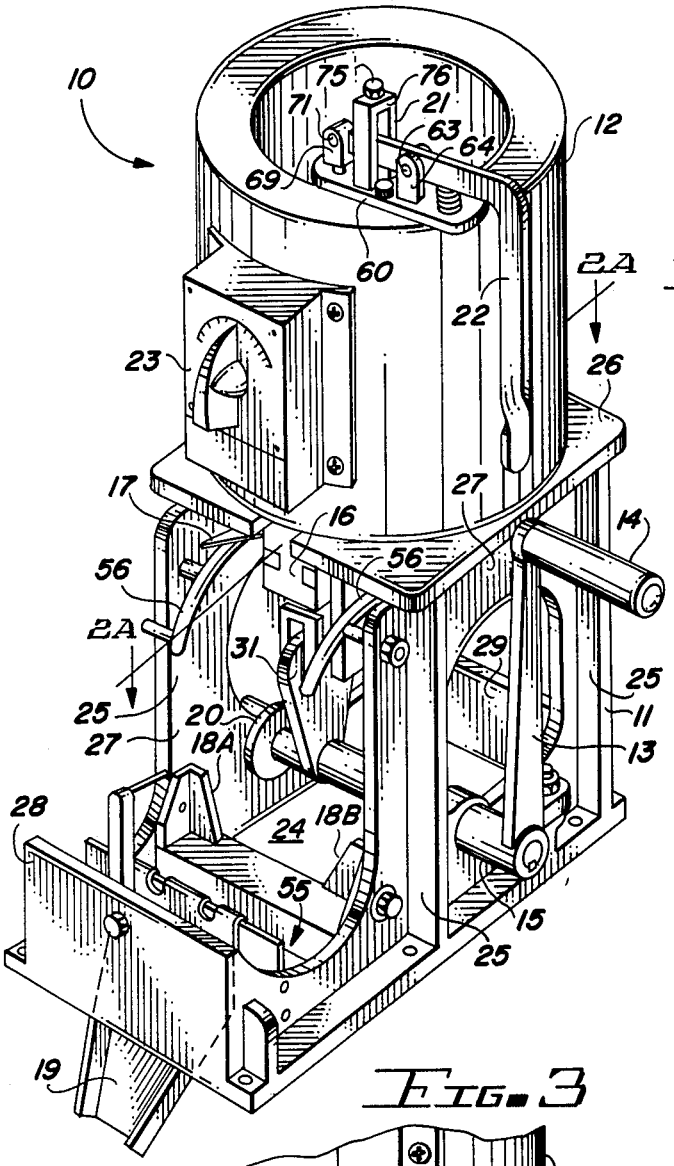
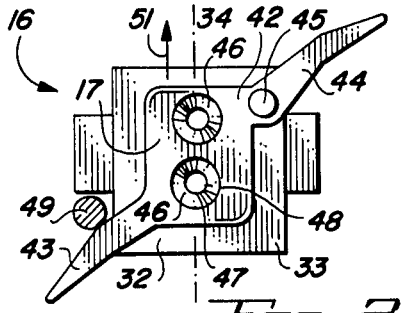
FIG. 2A
FIG. 2B
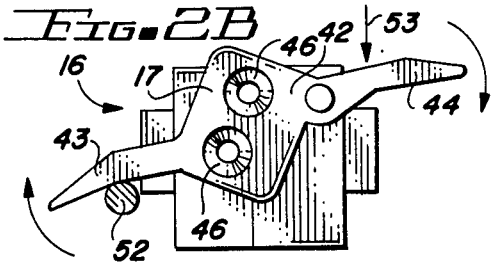
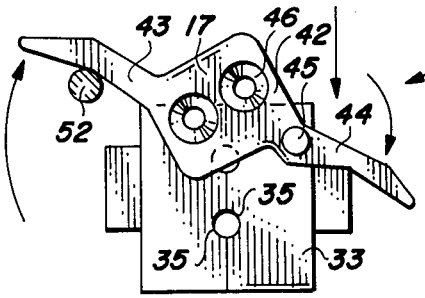
FIG. 2C
FIG. 2D
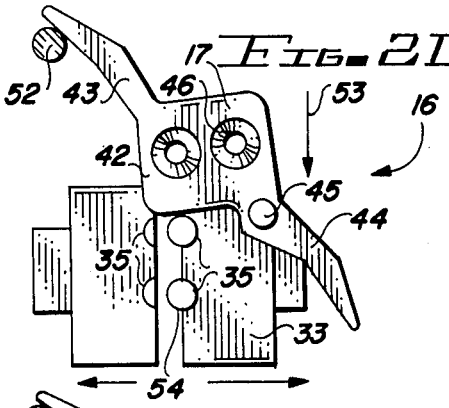
FIG. 3
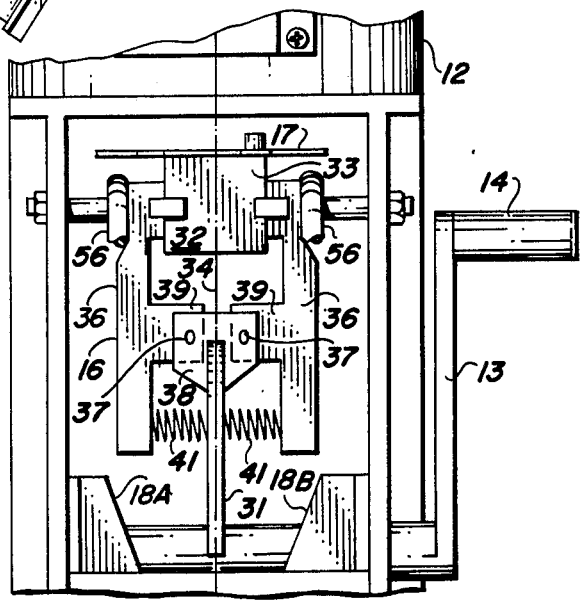
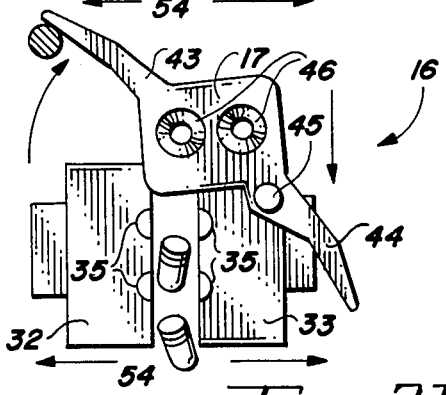
FIG. 2E

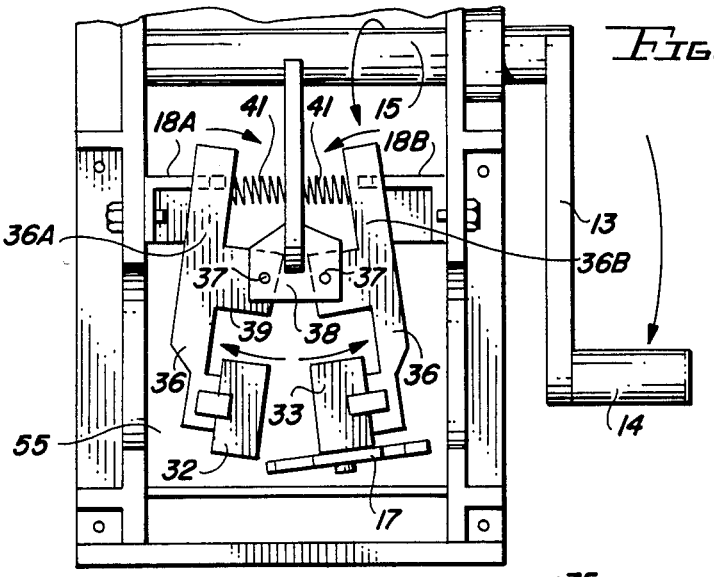
FIG. 4
FIG. 5
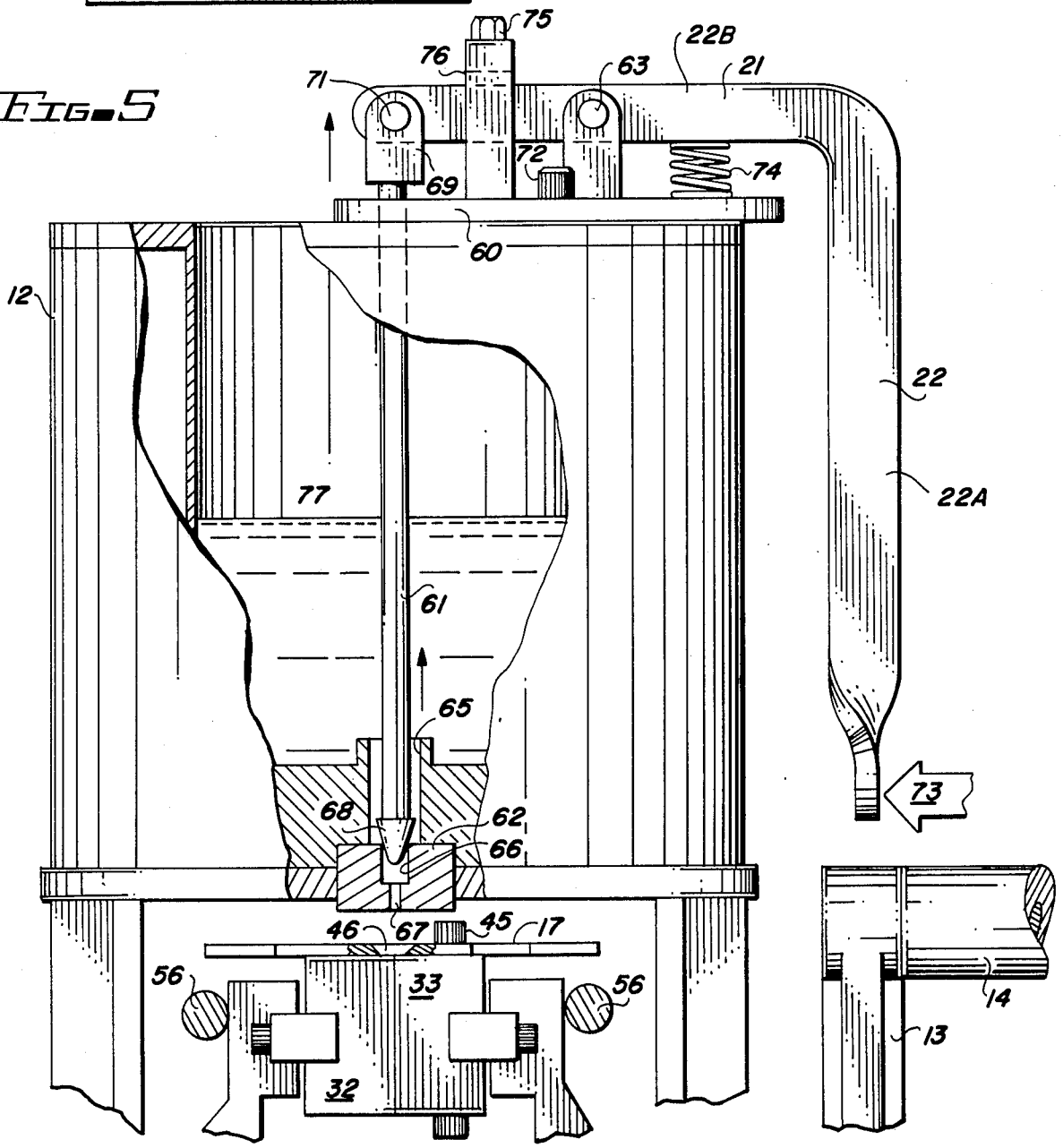

BULLET CASTING MACHINE

BACKGROUND OF THE INVENTION

For those who regularly fire rifles or pistols, the cost of ammunition is an expensive consideration. The professional law enforcement agent or avid sportsman may fire a hundred rounds or more of ammunition in a single practice session, with the expended raw materials used in addition to its monetary cost inevitably pointing to the need for an appropriate salvage operation to recover and reuse the spent shells.

DESCRIPTION OF THE PRIOR ART

Various types of shell reloading machines have been disclosed as, for example, the device described in U.S. Pat. No. 4,343,222. Such machines typically perform the several functions required in the reloading process. The exploded primer cap is removed, a new primer cap is installed, the end of the shell is enlarged to receive the bullet, the powder charge is loaded, and the new bullet is pressed into place.

One feature that is not generally provided in such devices is the capability of casting or forming new bullets for installation in the shells that are being reloaded. The present device, in providing a means for casting the replacement bullets, constitutes a means for reducing further the monetary cost of the ammunition expended by the frequent user of firearms.

SUMMARY OF THE INVENTION

In accordance with the invention claimed, a semi-automatic bullet casting machine is provided which is complimentary with the shell reloading machine referenced above. This bullet casting machine is hand operated by means of a crank that rocks back and forth to actuate the casting process.

It is, therefore, one object of this invention to provide a semi-automatic machine for the casting of bullets.

Another object of this invention is to provide as an element of such a machine a thermostatically controlled melting pot for melting the lead or other material from which the bullets are formed.

A further object of the invention is to provide as an element of such a machine a two cavity mold which permits the simultaneous casting of two bullets, thereby doubling the production rate of the machine.

A still further object of this invention is to provide in such a machine a capability for discharging the molten metal from the bottom of the melting pot into the molds, thereby eliminating the hazard of spilling the molten metal during the filling of the molds.

A still further object of this invention is to provide in such a machine automatic alignment of the mold with the discharge port of the melting pot.

A still further object of this invention is to incorporate in such a machine an automatic sprue cutter for the removal of the excess casting material from the bullet.

A still further object of this invention is to provide in such a machine as a safety feature a lead release or pouring mechanism requiring the presence of the operator's hand on the operating crank during the discharge of the molten metal.

A still further object of this invention is to provide in such a machine a capability for automatically opening the molds and discharging the finished bullets at the end of the casting operation.

A still further object of this invention is to provide in such a machine, means for separating automatically the cast bullets and the sprues that have been removed therefrom.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings in which:

FIG. 1 is a perspective view of the semi-automatic bullet casting machine of the invention;

FIG. 2A is a partial cross-sectional view of the machine of FIG. 1 as seen along line 2A—2A and showing the illustrated mechanism in the position for pouring molten metal into the molds;

FIG. 2B shows the mechanism of FIG. 2A in the position it assumes during the removal of the sprues from the cast bullets;

FIG. 2C shows the mechanism of FIGS. 2A and 2B during the clearing of the tops of the molds;

FIG. 2D shows the mechanism of FIGS. 2A—2C in the position assumed during the opening of the molds;

FIG. 2E shows the mechanism of FIGS. 2A—2D during the discharge of the finished bullets;

FIG. 3 shows a front view of the lower portion of the machine of FIG. 1 with the operator handle in the upward position;

FIG. 4 shows a top view of the forward parts of the machine 10 with the handle in its downward position; and FIG. 5 is a front view of the upper part of the machine of FIG. 1 with portions of the structure cut away to reveal details of the interior construction.

DESCRIPTION OF THE PREFERRED EMBODIMENT

Referring more particularly to the drawings by characters of reference, FIG. 1 discloses a bullet casting machine 10 embodying the invention and comprising a frame 11, an electrically energized thermostatically controlled metal melting pot 12, crank 13 with the operator's handle 14, an actuator shaft 15, a two-part, dual cavity mold or molding mechanism 16, a sprue-cutting plate 17, cam plates 18A and 18B, a sprue removal chute 19; a pouring mechanism 21 with its actuating lever 22 and a temperature control 23.

Frame 11 comprises a base plate 24, four upright supports 25, and a horizontal platform or table 26. Base plate 24 is rectangular with a length approximately twice its width. The supports 25 are positioned at the four corners of the rearward half of the plate 24. The square platform 26 is supported by the four supports 25 and the forward half of the base plate 24 lies forward of platform 26 leaving the area above the forward half of plate 24 open and unobstructed by any part of frame 11. The structure of frame 11 is strengthened and braced by means of metal webbing 27 on both sides that are joined to supports 25 and to front and rear plates 28 and 29, respectively.

Melting pot 12 is cylindrical and open at the top. Pot 12 is securely mounted upon platform 26.

Molding mechanism 16 is carried by a support arm 31 that extends perpendicularly from actuator shaft 15.

Arm 31 is parallel with crank 13, extending in the same direction from shaft 15. Shaft 15 is rotationally mounted just above base plate 24 at a position directly below melting pot 12, its pivotal bearings 20 being carried by the webbing 27.

Mechanism 16 comprises a two-part mold having a left-hand member 32 and a right-hand member 33. Members 32 and 33 are mirror images of each other. When crank 13 and arm 31 are in their upward positions, molding mechanism 16 is also in its upward position directly below pot 12, and members 32 and 33 are closed against each other at a parting plane 34 which vertically bisects frame 11 longitudinally thereof.

As shown in FIGS. 2C–2E, each of the two members 32 and 33 incorporates a pair of cavities or depressions 35. The two depressions 35 of member 32 are aligned with the two depressions 35 of member 33 and together they form the mold cavities for the bullets that are to be cast by the machine 10. The cavities thus formed open and the surfaces of members 32 and 33 which face upwardly when crank 13 is in the upright position shown in FIGS. 1 and 3.

Each of the members 32 and 33 has the general form of a rectangular block and each is secured at the top of a pivoting arm 36. Each of the arms 36 is pivotally mounted at its center to the outer extremity of arm 31. The pivotal mounting is achieved by means of a pivot pin 37 that passes through a plate 38 perpendicularly secured to the end of arm 31 and through a tab 39 that extends inwardly from arm 36. A compression spring 41 confined between arm 31 and the lower end of arm 36 urges the lower ends of arms 36 outwardly. The pivotal action produced by springs 41 about pivot pins 37 drives members 32 and 33 inwardly toward a closed position at parting plane 34 in which the mating cavities 35 form the molding cavities for the bullets.

As shown in FIGS. 2A–2E, sprue cutter 17 is formed from a flat sheet of metal. It has a rectangular, nearly square, center section 42 and tapered fingers 43 and 44 that extend diagonally from two opposite corners of center section 42. The cutter 17 is pivotally mounted against the surface of member 33 that faces upwardly when crank 13 is in its upward position. A pivot pin 45 passing through the base of finger 44 and into the body of member 33 provides the pivotal mounting.

Two tapered circular openings 46 in center section 42 are spaced apart a distance corresponding to the separation between the two cavities 35. The openings 46 are tapered from a smaller diameter 47 at the bearing surface of cutter 17 that lies against the surface of member 32 or 33 to a larger diameter 48 at the opposite surface of cutter 17. The tapered surface forms a sharp cutting edge at the bearing surface of cutter 17.

FIG. 2A shows the position of cutter 17 during the pouring operation which takes place while crank 13 is in its upward or upright position. FIG. 2A is a top view of members 32 and 33 and of cutter 17 for the pouring operation. The cutter 17 has been rotated to the position shown in FIG. 2A by a stationary positioning pin 49 that extends downwardly from an appropriate location on the underside of platform 26. It will be noted that pin 49 has caused cutter 17 to rotate about pin 45 in a clockwise direction while members 32 and 33 were moved in the direction of arrow 51 as activated by the upward motion of crank 13.

Following the pouring operation which will be described later,. crank 13 is moved forwardly and downwardly. During the initial forward movement of the crank as molding mechanism 16 moves forward, finger 43 encounters a second stationary pin 52, as shown in FIG. 2. As mechanism 16 continues to move forward in the direction of arrow 53, the restraint of finger 43 by pin 52 causes cutting plate 17 to rotate about pivot pin 45 in a clockwise direction. Openings 46 are thus forcibly moved away from their pouring positions of FIG. 2A and the sharp edges of openings 46 at their smaller diameters 47 cut through the newly congealed metal that has been poured into the molds separating the sprues from the bullets that have been formed in cavities 35.

As mechanism 16 continues its forward and downward motion as shown in successive positions by FIGS. 2C and 2D, plate 17 continues to rotate clockwise, with pin 52 still restraining finger 43. As the clockwise rotation of plate 17 progresses, center section 42 cleans the cavities 35.

The cam plates 18A and 18B, as shown in the front view of FIG. 3 and in the top view of FIG. 4, come into play toward the end of the downward motion of crank 13 and molding mechanism 16. As shown in FIG. 4, the downward motion of mechanism 16 brings the outer edges of the lower ends 36A and 36B into contact with the inwardly tapered surfaces of cam plates 18A and 18B. Further downward motion of mechanism 16 causes the lower ends 36 to be driven inwardly against the action of the springs. As the ends 36A and 36B are thus driven inward, arms 36 are pivoted about pins 37 so that members 32 and 33 at the opposite ends of arms 36 are moved apart, as shown in FIGS. 2D, 2E and 4. The bullets 54 are now free to fall from cavities 35, as in FIG. 2E, into a collection bin 55 while the separated sprues slide out of openings 46 into chute 19 which deposits them in a salvage container for subsequent remelting.

Because members 32 and 33 need to be held firmly together during the pouring operation, the closing pressure provided by springs 41 is not entirely relied upon. A more positive closing and holding force is provided in the form of two cam means or bars 56, as shown in FIGS. 1, 3 and 5. The bars 56 lie in planes that are nearly parallel to the plane of motion taken by mechanism 16 and they are formed in arcs that match the arcuate forward and downward motion of mechanism 16. At their upper ends, bars 56 converge against the outer surfaces of members 32 and 33 so that these members become wedged between the two bars 56 as they reach the upward position for pouring. In this way, bars 56 provide positive holding action needed for pouring.

Metering means for controlling the flow of molten metal into cavities 35 may comprise a pouring mechanism 21 which comprises a mounting plate 60, actuating lever 22, a needle valve 61, and an orifice means 62.

Actuating lever 22 is "L" shaped, its longer segment 22A extending downwardly for use as a handle, as shown in FIG. 5, and its shorter segment 22B pivotally mounted at its center by means of a pivot pin 63 at the top of a support post 64. Post 64 extends vertically upwardly from plate 60.

Orifice means 62 comprises an upper cylindrical channel 65, a lower cylindrical channel 66, and a dual channel exhaust port 67. Channel 65 has a diameter approximately twice that of channel 66, and the two are concentrically aligned about a common vertical axis located at the center of melting pot 12. Exhaust port 67 opens at its upper end into channel 66; its dual exhaust ports are vertically aligned with the two openings 46 of plate 17 and with the two molding cavities 35 when the mechanism 16 is in the pouring position. Channel 66 opens at its upper end into channel 65 and the upper end of channel 65 opens into the bottom of melting pot 12.

Needle valve 61 comprises a long rod with a cone-shaped tip 68 at one end and with a clevis 69 at the other end. Needle valve 61 is vertically suspended inside pot 12, the clevis 69 being pivotally attached to segment 22B of lever 22. Tip 68 extends into channel 65 with channel 65 being sufficiently larger in diameter than the maximum diameter of tip 68 to permit the flow of molten metal about tip 68, but not so much larger as to preclude its usefulness in guiding the lower pointed end of tip 68 into the open upward end of channel 66 as needle valve 61 is lowered therein.

Plate 60 is secured to the top of pot 12 by means of a thumb screw 72 that screws into the vertical wall of pot 12.

By virtue of the pivotal mounting of lever 22 at the center of its horizontal segment 22B, needle valve 61 may be raised by moving the lower end of segment 22A of lever 22 toward the wall of pot 12 in the direction of arrow 73. To move needle valve 61 downwardly, the lower end of segment 22A is moved away from pot 12 in a direction opposite that indicated by arrow 73. If the lower end of segment 22A is moved sufficiently far from pot 12, the cone-shaped tip of point 68 becomes wedged into the upper end of channel 66 closing it off entirely. To secure needle valve 61 in such a closed position in the absence of any manually applied force to lever 22, a compression spring 74 is interposed between plate 60 and segment 22B on the side of pin 63 and post 64 opposite the pivotal mounting of needle valve 61. The action of spring 74, as shown in FIG. 5, is thus to move the right-hand end of segment 22B upwardly so that the left-hand end pivots downwardly about pin 63 to lower needle valve 61 into its closed position.

It will be recognized that as the cone-shaped tip 68 begins to rise from the closed position, the clearance between tip 68 and the top of channel 66 increases in proportion to the upward displacement of tip 68 from the closed position. The flow rate of the molten metal through orifice 62 increases accordingly. A maximum flow rate can thus be set by limiting the upward displacement of tip 68. This is accomplished by means of a set screw 75 mounted atop a bridge 76 that passes over the left-hand end of segment 22B of lever 22. Now when the lower end of segment 22A is manually activated in the direction of arrow 73, the maximum pivotal motion of lever 22 and hence the maximum flow rate of molten metal is adjustably controlled by the setting of screw 75.

Operation of casting machine 10 proceeds as follows:

Pot 12 is first loaded with a charge of lead stock or other bullet casting material which may include the sprues that have been trimmed from the cast bullets during a previous casting operation. The thermostat connected to a source of electric power is then set at the desired temperature. After the casting material 77 has been melted and raised to the desired temperature, crank 13 is raised to its upward position by the operator. While observing the top of plate 17 from the unobstructed viewpoint shown in FIG. 5, the operator then moves lever 22 in the direction of arrow 73. Molten metal will be observed flowing in two streams from orifice 62 into openings 46 of plate 17. When the cavities 35 below the openings 46 have filled, the molten metal builds up forming molten domes over the openings 46 that are visible to the operator. Lever 22 is released by the operator at this time. Crank 13 is then moved forwardly and downwardly to effect the removal of the sprues and the ejection of the cast bullets as described earlier. The crank 13 is then raised again in preparation for the next casting cycle. If the molten metal flow rate is found to be too high to permit effective control at the end of the pour, or if it is found to be too slow to permit an effective casting rate, the screw 75 may be adjusted as appropriate.

An effective bullet casting machine is thus provided that is characterized by a very simple operating procedure. For each pair of bullets cast, the crank 13 is moved up, lever 22 is operated to fill the cavity and crank 13 is moved back down to trim and eject the bullets. The simplicity of the casting operation permits a high production rate, and the automatic closure of valve 61 by means of spring 74 enhances the safety of the machine 10 by preventing the flow of molten metal except when the operator's hand is on the lever 22 and while his attention is presumably on the flow of metal from orifice 62.

Although but a single embodiment of the invention has been illustrated and described, it will be apparent to those skilled in the art that various changes and modifications may be made therein without departing from the spirit of the invention or from the scope of the appended claims.

What is claimed is:

1. A hand operated semi-automatic bullet casting machine comprising:

a frame, an electrically energized metal melting pot mounted on said frame for dispensing molten metal through an orifice in its bottom, a horizontal actuator shaft rotatably mounted within said frame below said melting pot, a support arm rigidly secured at one end to said actuator shaft and extending substantially perpendicularly therefrom, mold means mounted on said support arm below said melting pot and having at least one cavity for aligning with said orifice, said mold means comprising two relatively movable portions normally biased into engagement with each other and forming between their juxtapositioned engaging portions and cavity, metering means mounted on said melting pot for controlling the flow of molten metal from said melting pot through said orifice and into said cavity of said mold means, said metering means comprising a valve means for opening and closing said orifice, a pivotally movable flat plate having at least one aperture extending therethrough mounted on a face of said mold means for movement thereover from a first portion to a second portion laterally of the longitudinal axis of said melting pot and said mold means for aligning in the first position said aperture with said orifice and said cavity, pin means mounted on said frame for engaging said flat plate upon movement of said mold means to rotate said flat plate from said first position to said second position, said aperture having a sharp edge immediately adjacent said cavity for cutting off any sprue of the bullet extending out of said cavity upon rotation of said plate to the second position, spring biased lever means mounted on said melting pot and connected to said valve means for normally closing said valve means under the bias of its spring, crank means secured to one end of said actuator shaft for manually rotating said shaft, support arm and said mold means and causing movement of said flat plate, said rotation comprising upward and downward strokes of said crank means, cam means mounted at the bottom of said frame and positioned to engage said mold means near the end of its downward stroke, said crank means when moved upwardly rotating said two rotatively movable portions of said mold means into engagement, said cavity in alignment with said orifice of said melting pot, and said flat plate to a first position for a pouring operation, said lever means when actuated opening said valve means causing molten metal to flow from said melting pot through said orifice and into said cavity until filled, sequential downward movement of said crank means causing rotative movement of said flat plate to cause said sharp edges of said apertures to trim away any sprue extending out of said cavity and engagement of said mold means with said cam means to cause separation of the movable portions of said mold means causing the molded bullet formed in said cavity to fall free from said mold means.

2. The hand operated semi-automatic bullet casting machine set forth in claim 1 wherein:

said support arm comprises two pivotally movable arms each mounted at its center on opposite sides of said support arm, said movable portions of said mold means being mounted one on each of a first common end of said movable arms and biased into engagement with each other by a compression spring means mounted between the other common ends of said movable arms, said movable portions each having a depression in engaging surface thereof which meet when said movable portions engage to form said cavity of said mold means.

3. The hand operated semi-automatic bullet casting machine set forth in claim 1 wherein:

said flat plate comprises at least one finger extending laterally therefrom, and pin means comprises a pair of spacedly mounted pins one for engaging each of said fingers upon movement of said mold means to cause rotation of said flat plate sequentially to said first position and said second position.

4. The hand operated semi-automatic bullet casting machine set forth in claim 1 in further combination with;

a set screw mounted on said melting pot for adjustably limiting the movement of said lever means and said valve means to control the opening of said orifice.

5. The hand operated semi-automatic bullet casting machine set forth in claim 1 in further combination with:

cam means mounted on said frame and actuated by said crank means when moved to said first position for engaging opposed parts of said portions of said mold means to wedge said portions together.

* * * * *

UNITED STATES PATENT OFFICE

CERTIFICATE OF CORRECTION

Patent No. 4,624,297 Dated November 25, 1986

Inventor(s) Robert L. Clausen

It is certified that error appears in the above-identified patent and that said Letters Patent are hereby corrected as shown below:

Claim 1, line 18, cancel "and" and substitute ---said---.

Signed and Sealed this

Twenty-fourth Day of February, 1987

*Attest:*

DONALD J. QUIGG

*Attesting Officer* *Commissioner of Patents and Trademarks*